US006457522B1

(12) United States Patent
Bangash et al.

(10) Patent No.: US 6,457,522 B1
(45) Date of Patent: Oct. 1, 2002

(54) CLEAN WATER INJECTION SYSTEM

(75) Inventors: Yasser Khan Bangash, Norman, OK (US); John Derek Jones, LaGrange, TX (US); Michael R. Berry, Norman, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 0 days.

(21) Appl. No.: 09/724,807

(22) Filed: Nov. 28, 2000

Related U.S. Application Data

(60) Provisional application No. 60/211,867, filed on Jun. 14, 2000.

(51) Int. Cl.[7] ..... E21B 43/40

(52) U.S. Cl. ..... 166/267; 166/75.12; 166/66.4; 166/68; 166/105.5; 166/263

(58) Field of Search ..... 166/265–267, 166/263, 75.12, 90.1, 66.4, 68, 105.5, 106, 107

(56) References Cited

U.S. PATENT DOCUMENTS

| | | | | |
|---|---|---|---|---|
| 3,709,292 A | * | 1/1973 | Palmour | 166/68 |
| 4,296,810 A | | 10/1981 | Price | |
| 4,354,553 A | * | 10/1982 | Hensley | 166/250.05 |
| 4,688,650 A | | 8/1987 | Hayatdavoudi et al. | |
| 4,738,779 A | | 4/1988 | Carroll et al. | |
| 4,805,697 A | | 2/1989 | Fouillout et al. | |
| 4,844,817 A | | 7/1989 | Flanigan et al. | |
| 5,110,471 A | | 5/1992 | Kalnins | |
| 5,154,588 A | * | 10/1992 | Freet et al. | 417/423.3 |
| 5,154,826 A | | 10/1992 | Prendergast et al. | |
| 5,296,153 A | | 3/1994 | Peachey | |
| 5,302,294 A | | 4/1994 | Schubert et al. | |
| 5,335,732 A | | 8/1994 | McIntyre | |
| 5,456,837 A | | 10/1995 | Peachy | |
| 5,482,117 A | | 1/1996 | Kolpak et al. | |
| 5,693,225 A | | 12/1997 | Lee | |
| 5,711,374 A | | 1/1998 | Kjos | |
| 5,730,871 A | | 3/1998 | Kennedy et al. | |
| 5,860,476 A | | 1/1999 | Kjos | |
| 6,017,456 A | | 1/2000 | Kennedy et al. | |
| 6,033,567 A | * | 3/2000 | Lee et al. | 210/512.2 |
| 6,068,053 A | | 5/2000 | Shaw | |
| 6,131,655 A | | 10/2000 | Shaw | |
| 6,138,758 A | * | 10/2000 | Shaw et al. | 166/265 |

FOREIGN PATENT DOCUMENTS

| | | |
|---|---|---|
| NO | 19980767.00 | 2/1998 |

* cited by examiner

*Primary Examiner*—David Bagnell
*Assistant Examiner*—Zakiya Walker
(74) *Attorney, Agent, or Firm*—Crowe & Dunlevy

(57) ABSTRACT

The present invention provides a clean water separation system with an electric submersible pumping device and a surface separator and pumping device for the separation and transfer of different density fluids and solids. The electric submersible pumping device can be an encapsulated device that works in conjunction with a separator and pumping system that are located on the surface, to separate fluids and solids.

10 Claims, 7 Drawing Sheets

CLEAN WATER INJECTION SYSTEM

RELATED APPLICATIONS

This application claims the benefit of Provisional Application No. 60/211,867 entitled "Clean Water Injection System" filed Jun. 14, 2000.

FIELD OF INVENTION

The present invention relates generally to the field of water separation, and more particularly, but not by way of limitation, to a water separation system having a submersible pump.

BACKGROUND OF INVENTION

Handling water in high water cut fields presents a big problem for oil and gas producers. Fluid separation and reinjection systems are an important and expensive part of most hydrocarbon production facilities. The separation of fluids and solids based on different properties is known in the industry. A variety of separation methods are used, including gravity separators, membrane separators and cyclone separators. Each of these separator types uses a different technique to separate the fluids and each a different efficiency depending upon the device and its application.

Gravity separators, for instance, can be efficient when there is a great density difference between the two fluids and there are no space or time limitations. Another type of separator, the membrane separator, uses the relative diffusibility of fluids for separation. Any separation method that is time dependant, such as the above mentioned gravity and membrane separators, does not work well with an electric submersible pump underground but can be adapted if the separator is located above ground. Electric submersible pumps (ESP) are capable of producing fluids in a wide volume and pressure range and are often used for downhole fluid production. These pumps are used very efficiently for applications where downhole oil water separation devices are used.

Hydro cyclone separators are non-rotating devices, using a specific geometric shape to induce fluid rotation. This rotation creates high g-forces in the fluids as the fluids spin through the device. This process results in the lighter fluids forming a core in the middle of the separator. In the handling of oil and water mixtures, the inner core is extracted out of the topside of the hydro cyclone separator as a production oil stream. The separated water is rejected from the bottom side. One problem associated with this type of separator is the large pressure drop experienced as the fluid passes through the hydro cyclone.

There is a need in the industry for a less expensive, simple clean water injection system that can be placed at any location in the wellbore, is adaptable to changing conditions and can handle large volumes of water and other debris such as sand.

The present invention, overcomes these problems by providing a system using a separation and pumping device on the surface in conjunction with an submersible pumping device.

SUMMARY OF INVENTION

The present invention provides a clean water injection system featuring a downhole electric submersible pumping device coupled with a surface separator and a high pressure surface pumping system for the separation and transfer of separated fluids to different locations or zones. Since the separator and pumping system are on the surface, the separation system arrangement is not restricted to downhole conditions.

The objects, advantages and features of the present invention will become clear from the following detailed description and drawings when read in conjunction with the claims.

DETAILED DESCRIPTION

Figure 1:
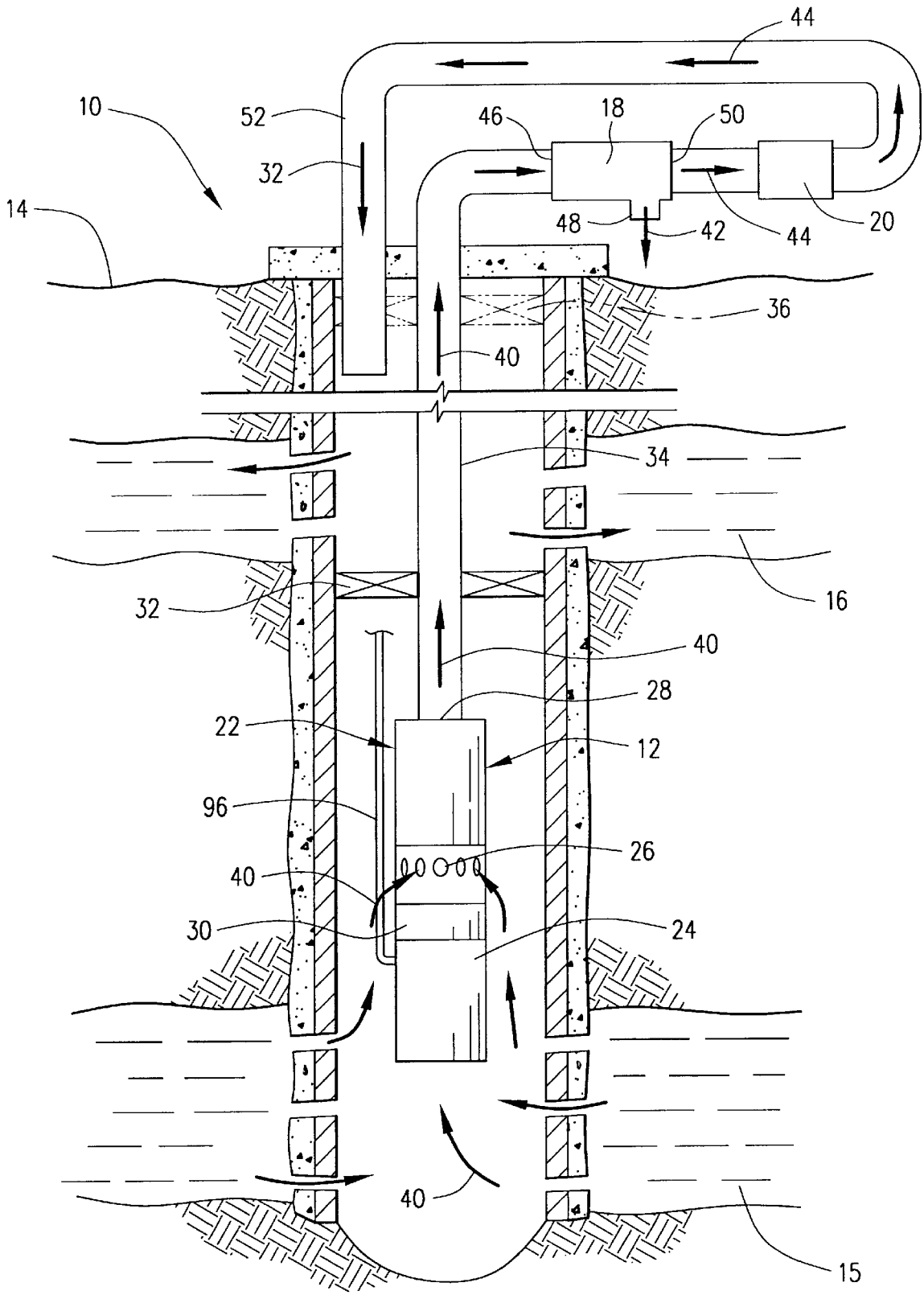
FIG. 1 is a diagrammatical, partially detailed, elevational view of a clean water injection system with a downhole electric submersible pumping device constructed in accordance with the present invention.

Referring generally to the drawings, and in particular to FIG. 1, shown therein is a clean water injection system 10 constructed in accordance with the present invention. The clean water injection system 10 has a downhole electric submersible pumping device 12 along with tubing and packers, as necessary, for use in a wellbore below the earth's surface 14 and extending through a hydrocarbon producing zone 15 and a water injection zone 16. It will be understood by those skilled in the art that the hydrocarbon producing zone 15 will actually produce a hydrocarbon and water mixture with the percentage of water varying from an acceptable level to a level where it is economical to separate produced water. It is to the latter situation that the present invention is directed. The clean water injection system 10 also includes a surface separator 18 and horizontal pumping system 20 that will be discussed in more detail below.

The electric submersible pumping device 12 has a multistage pump assembly 22 and an electric submersible motor assembly 24. The pump assembly 22, well known in the art, has a pump inlet 26 and a pump outlet 28 through which fluids are forced to the surface 14. The electric submersible motor assembly 24, protected by a motor seal section 30, is capable of powering the pump assembly 22.

A conventional first packer 32 is set on a production tubing 34 which is disposed to extend in the wellbore to support the electric submersible pumping device 12 and to received pressurized production fluids from the pump outlet 28. The first packer 32 separates the hydrocarbon production zone 15 and the water injection zone 16 in the wellbore. A second packer 36 can be disposed above the first packer 32 for pressure control and isolation between the injection zone 16 and the surface 14, if necessary.

As mentioned above, the clean water injection system 10 includes the separator 18 located on the surface 14 to separate a produced hydrocarbon and water fluid mixture 40 into a hydrocarbon-rich stream 42 and a water-rich stream 44.

The separator 18 has an inlet 46 in fluid communication with the electric submersible pumping device 12, a first outlet 48 for the hydrocarbon-rich stream 42 and a second outlet 50 for the water-rich stream 44. The separator 18 can be any type of separator capable of separating fluids of different properties such as density. One such separator 18 is a single or multistage hydro cyclone separation device like the one described in Read Well Service U.S. Pat. No. 5,860,476 and Norwegian Pat # 19,980,767. Another is a rotary separator such as the one described in the applicants co-pending application Ser. No. 60/211,868 which would require torque transfer from another motor. One skilled in the art will recognize other separators that could separate fluids by properties such as density.

The separator 18 is in fluid communication with the electric submersible pumping device 12 which pressurizes the hydrocarbon-rich stream 42 for production. The electric submersible pumping device 12 produces fluid 40 through a piece of standard tubing attached to the bottom. Production fluid is pressurized in the pump and the fluid mixture 40 is fed into the separator 18 and separated on the basis of different fluid densities. The heavier fluid in the water-rich stream 44 is transferred to the injection zone 16 through reinjection tubing 52 and the lighter fluid in the hydrocarbon-rich stream 42 is transferred to a container (not shown) on the surface 14. One skilled in the art will realize that additional containers or reservoirs may be located between the surface 14 and the separator 18 or between the separator and the other pumps or injection wells.

The clean water injection system 10 also includes the horizontal pumping system 20 located on the surface that is capable of pressurizing the water-rich stream 44 for reinjection in the same wellbore. A person skilled in the art will recognize that the horizontal pumping system 20 can be of many different types including the Wood Group horizontal pumping system available from the assignee of the present invention. The horizontal pumping system 20 is sized such that it produces enough pressure to reinject the water-rich stream 44 for reinjection in the same wellbore. The horizontal pumping system 20 can also be sized to reinject the water-rich stream 44 into more then one wellbore. The horizontal pumping system 20 can also supply the torque transfer for the separator 18 if it is a rotary separator on the surface.

The electric submersible pumping device 12 hangs by the tubing 34 which stings into the first packer 32. A valve (sliding sleeve/master valve) can be installed with the packer for control purposes. The power cable (not shown) also penetrates the packer 32, by methods that one skilled in the art would understand.

Figure 2:
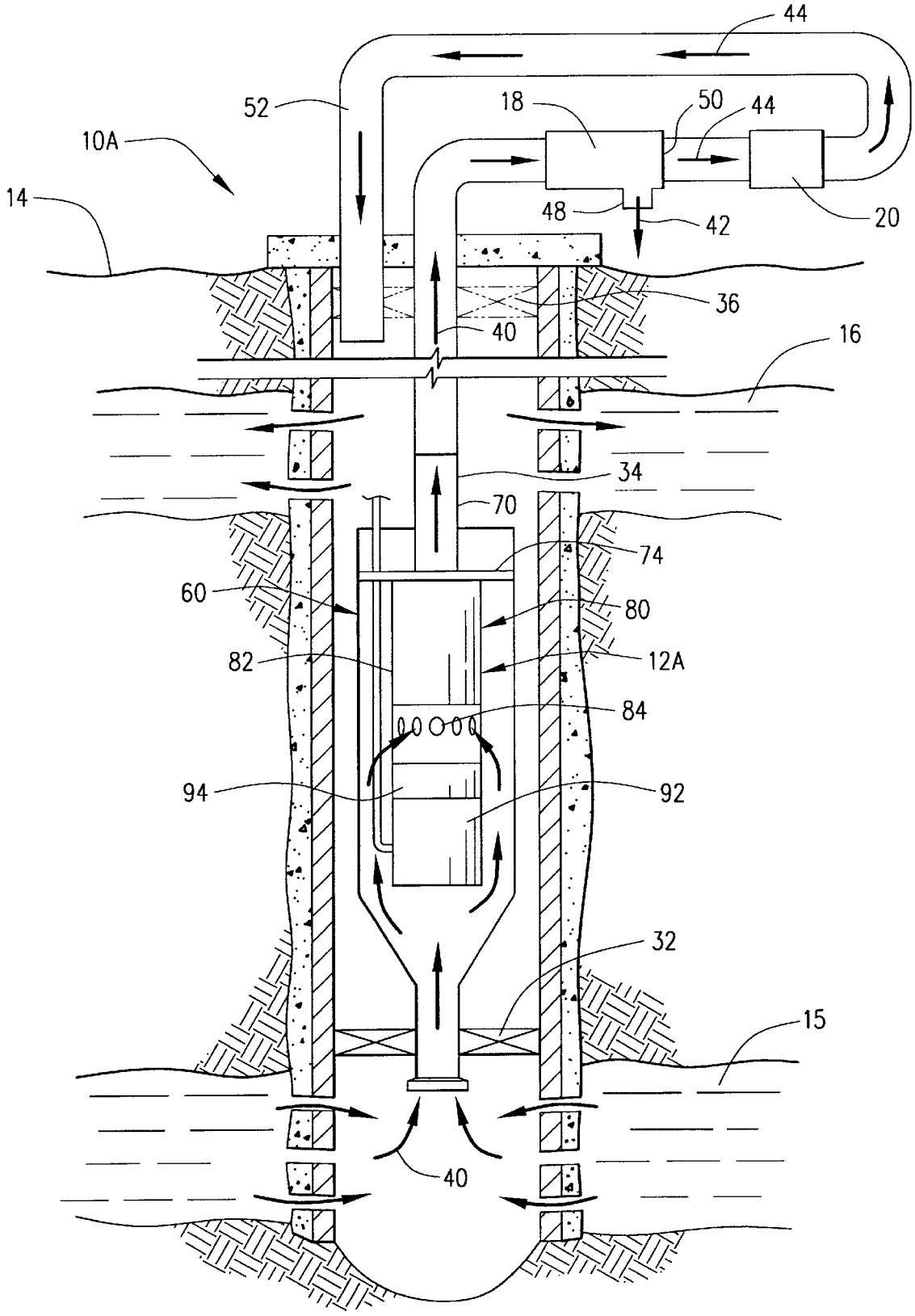
FIG. 2 is a diagrammatical, partially detailed, elevational view of the system of FIG. 1 as modified by removing the packer and enclosing the electric submersible pumping device in an encapsulated system.

FIG. 2 shows a clean water injection system 10A similar to the clean water injection system 10 discussed in FIG. 1 but with an electric submersible pumping device 12A enclosed in an encapsulated electric submersible pumping device 60 for use in the wellbore and with the packer positioned below the encapsulated electric submersible pumping device 60. The encapsulated device 60 is in fluid communication with the separator 18 for pressurizing the hydrocarbon and water mixture 40 for production and separation.

Figure 3:
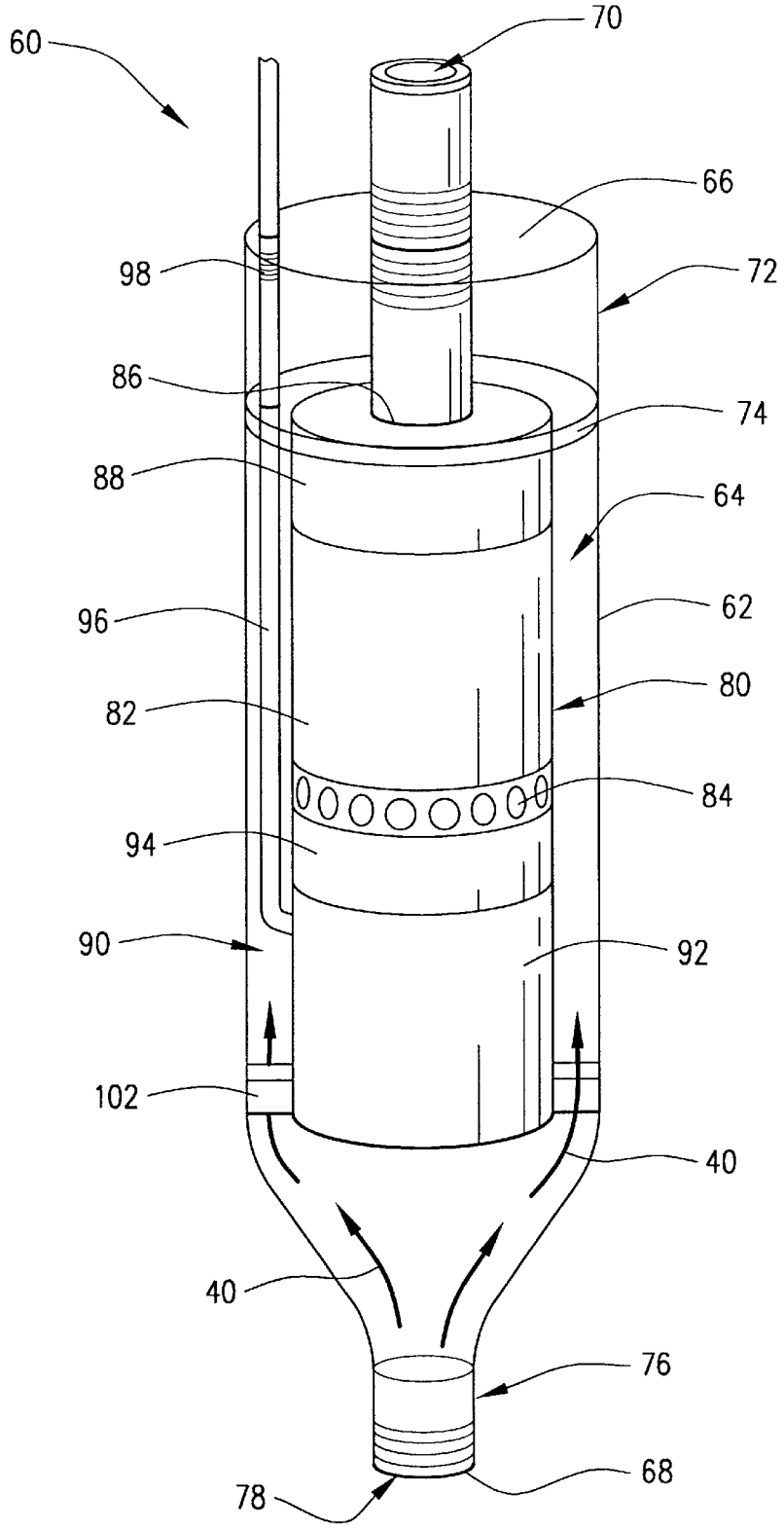
FIG. 3 is a diagrammatical representation of the encapsulated electric submersible pumping device of FIG. 2.

FIG. 3 shows the encapsulated electric submersible pumping device 60 has a device body 80 forming a chamber 64 having an upper surface 66 and a lower surface 68 The upper surface 66 has a device outlet 70 via an upper connection device 72 with a pressure seal 74. The lower surface 68 abuts a lower connection 76 and includes a device inlet 78 in fluid communication with the produced hydrocarbon and water mixture 40 from the production zone 15 via inlet 78. Supported inside the device body 80 is a pump assembly which has a pump 82 with a pump inlet 84 in fluid communication with the production zone 15 via inlet 78. The pump 82 also has a pump outlet 86, shown here in a pump discharge head 88, which is in fluid communication with the device outlet 70.

The encapsulated electric pumping device 60 also includes an electric submersible motor assembly 90. This electric submersible motor assembly 90 includes an electric submersible motor 92 supported in the device body 80 and connected to the pump 82 by an electric submersible motor seal 94. The electric submersible motor 92 is produced by companies such as the assignee of the present invention; for example, models WG-ESP TR-4 and TR. The device body 80 also includes a means of power transfer, such as a power cable 96, for transferring power from a power source to the electric submersible motor assembly 90 through a power connector 98 with a pressurized seal such as the high pressure seals on the high pressure cable connection QCI model feed through system made by Wood Group ESP, Inc., the assignee of the present invention.

The produced fluid mixture 40 flows along the motor 92, thereby helping to achieve the required cooling by keeping the velocity of fluid around the motor 92 to a minimum of 1 ft/sec, helping to prolong the motor life. The produced fluid mixture 40 enters the pump inlet 84 and is pumped to the separator 18 on the surface 14. The separated water 44 enters the horizontal pumping system 20 and is reinjected via tubing string 52.

Figure 4:
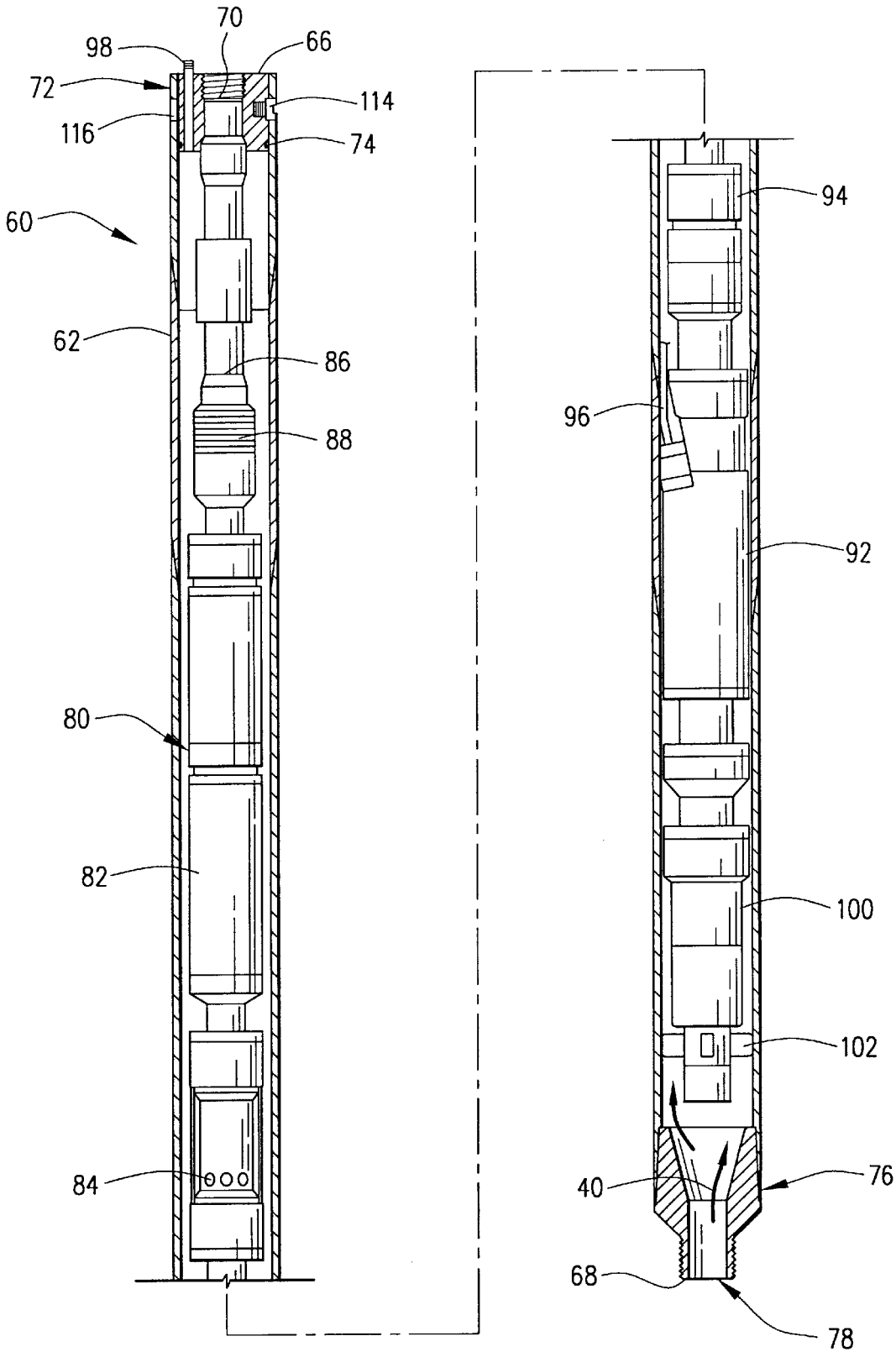
FIG. 4 is a partially cutaway, partially detailed, elevational view of the encapsulated electric submersible pumping device of FIG. 2.

FIG. 4 shows the encapsulated electric submersible pumping device 60 of the present invention in more detail. The device body 80 is made up of a series of casing joints screwed together. The power cable 96 has been removed to make the components of the encapsulated electric submersible pumping device 60 easier to show.

One skilled in the art will recognize that the encapsulated electric submersible pumping device 60 can have additional components such as a sensor 100 located adjacent to the motor 92 for sensing mechanical and physical properties, such as vibration, temperature, pressure and density, at that location. This sensor or other sensors, such as the commercially available Promore MT12 or MT13 models, can also be located adjacent to the pump 82, the separator 18, or the surface 14. One skilled in the art will understand that one or more of these sensors would be helpful to the operation of the encapsulated electric submersible pumping device 60 or the downhole electric submersible pumping device 12. It is also well known that the use of a centralizer 102, can optimize performance of the system.

Figure 5:
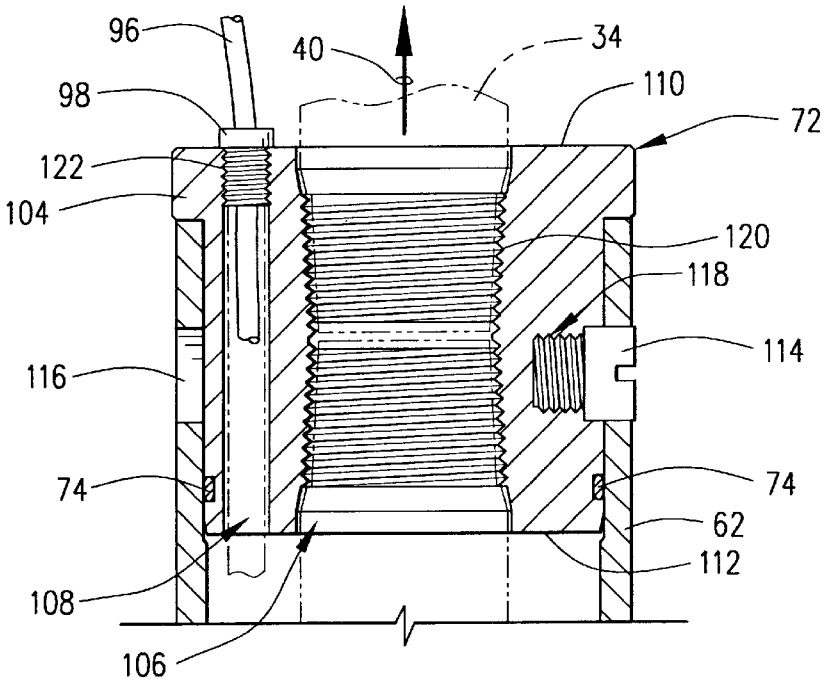
FIG. 5 is a partially detailed, cross-sectional, elevational view of the upper portion of the device of FIG. 2.

FIG. 5 shows the upper connection 72 of the encapsulated electric submersible pumping device 60. The upper connection 72 is a hanger with a hanger body 104 forming a first chamber 106 and a second chamber 108. The upper connection 72 has an upper surface 110 (which is the same as the device upper surface 66) and a lower surface 112. The hanger body 104 of the upper connection 72 is supported by the device body 80 with fasteners 114 (one shown) that connect an opening 116 in the device body 80 and an opening 118 in the hanger body 104.

The first chamber 106 has a means of connection, preferably a threaded connection 120, capable of supporting the pump assembly 80 in the hanger body 104. The second chamber 108 has a means of connection, preferably a threaded connection 122, capable of supporting a cable connection (not shown) in the hanger body 104. The pressure seal 74 is disposed in a ring channel to seal between the device body 80 and the hanger body 104. This seal 74 is capable of isolating the pressure from below the hanger body 104 from the pressure above the hanger body 104.

Figure 6:
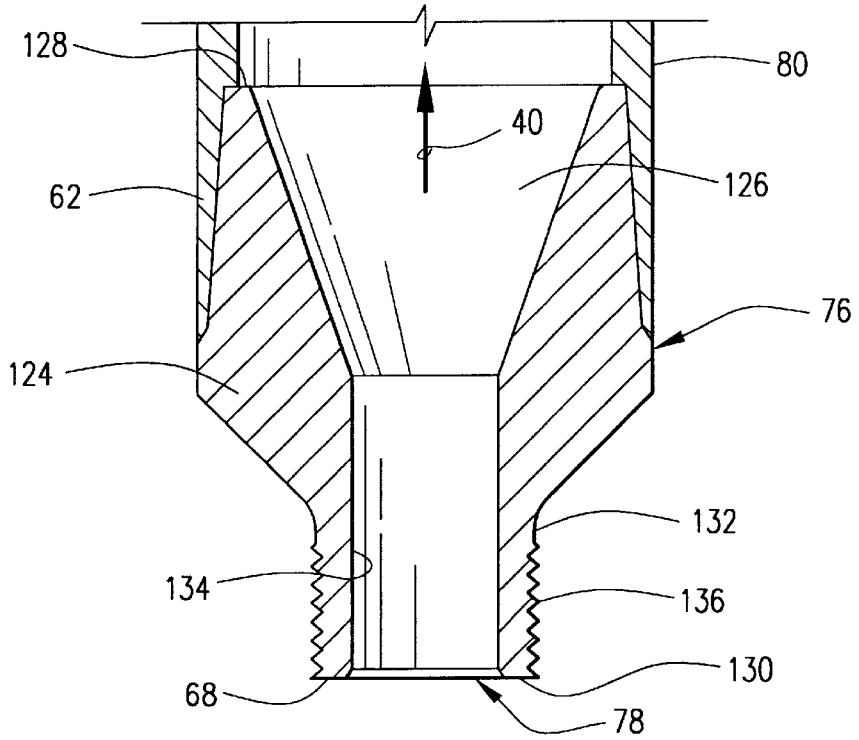
FIG. 6 is a cross-sectional, partially detailed, elevational view of the lower portion of the device of FIG. 2.

FIG. 6 shows the lower connection 76 of the encapsulated electric submersible pumping device 60. The lower connection 76 has a base body 124 forming a chamber 126 having an upper surface 128 and a lower surface 130, which is the device lower surface 68. The base body 124 of the lower connection 76 is supported by the device body 80. The device body 80 can be attached to the base body 124 with fasteners such as screws or by welding. The device body 80 can also be held by a press fit or a design feature, such as a lip, coupled with external forces. The base body 124 has an outer surface 132 and an inner surface 134 such that the outer surface 132 has a connection means, such as threads, capable of supporting other objects, such as joints of tubing or other devices. The lower surface 130 contains the encapsulated device inlet 78 for accepting the flow of produced fluid mixture 40.

An extra joint of tubing (not shown) can be screwed onto the base 68 of the lower connection 76 and this tubing can sting into the first packer 32. A control valve can be installed with the packer so that when the control valve actuates, the produced fluids 40 communicate with the pump 82.

Figure 7:
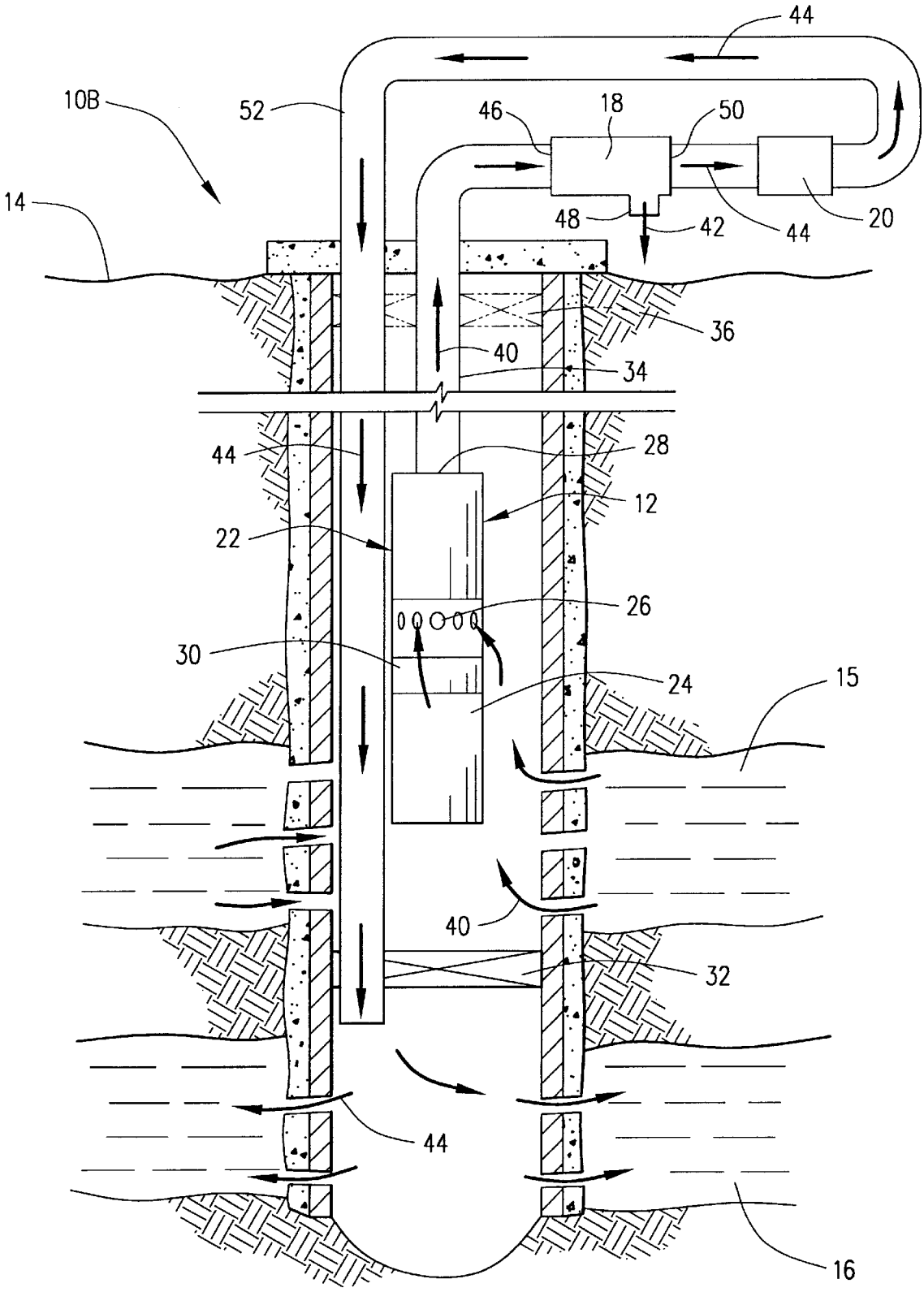
FIG. 7 is a diagrammatical, partially detailed, elevational view of the downhole electric submersible pumping device of FIG. 1 with the injection zone below the production zone and modified by the movement of the packer.

FIG. 7 shows a shows a clean water injection system 10B similar to the clean water injection system 10 described in FIG. 1 but with the location of the production zone 15 and injection zone 16 switched. In this case, the injection zone 16 is below the production zone 15. As shown in FIG. 7, this change in the relative vertical zone location and/or distance between zones does not require a change in design to the electric submersible pumping device 12. All that is required is relocating the first packer 32 below the downhole electric submersible pumping device 12 and an additional length of reinjection tubing 52. The produced fluid mixture 40 is pressurized in the downhole electric submersible pumping device 12 and enters the separator 18 on the surface 14. The produced fluid mixture 40 in the separator 18 is separated into the two streams. The water rich stream 44 is ejected out of the separator 18 to be reinjected to the injection zone 16. An alternative pump that could be used is a sidesaddle pump.

Figure 8:
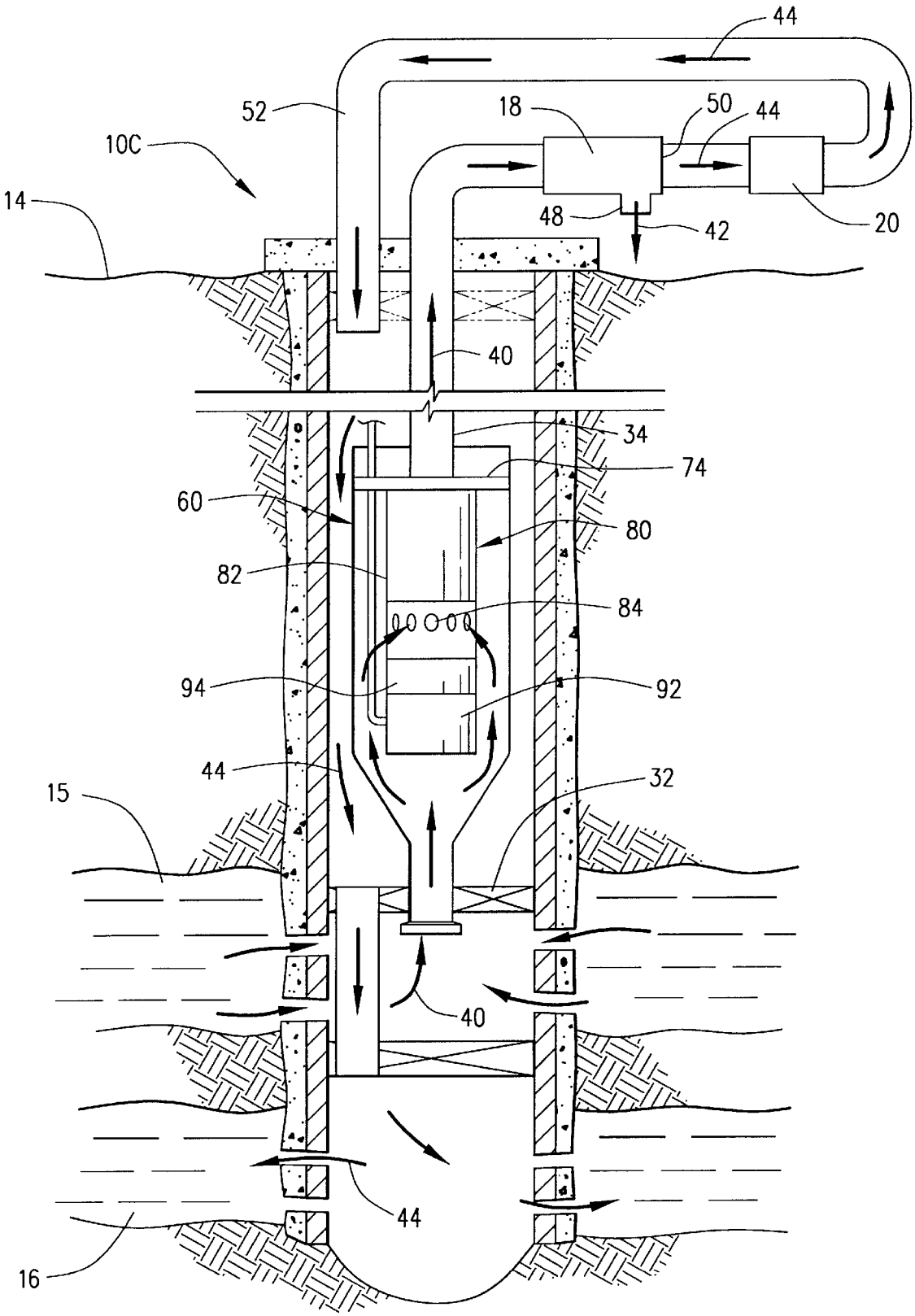
FIG. 8 is a diagrammatical, partially detailed, elevational view of the system of FIG. 1 with the injection zone below the production zone and modified by removing the packer and encapsulating the downhole motor and pump.

FIG. 8 shows a shows a clean water injection system 10C similar to the clean water injection system 10A described above, but with the location of the production zone 15 and injection zone 16 switched. In this case, the injection zone 16 is below the production zone 15. As shown in FIG. 8, this change in the relative vertical zone location and/or distance between zones does not require a change in design to the encapsulated electric submersible pumping device 60. All that is required is relocating the first packer 32 below the downhole electric submersible pumping device 12 and an additional length of reinjection tubing 52. The produced fluid mixture 40 is pressurized in the encapsulated electric submersible pumping device 60 and enters the separator 18 on the surface 14. The produced fluid mixture 40 in the separator 18 is separated into the two streams. The water rich stream 44 is ejected from the separator to be reinjected to the injection zone 16.

It will be clear to those skilled in the art that more than one encapsulated electric submersible pumping device 60 could be used in one wellbore. It will also be clear to those skilled in the art that additional separators, pumps and or motors can be used in conjunction with the encapsulated electric submersible pumping device 60 as well as permanent and semi-permanent packers.

The clean water injection systems 10 and 10B, with the downhole submersible pumping devices 12, and clean water injection systems 10A and 10C, with the encapsulated electric submersible pumping devices 60, can be incorporated as one part of a larger system to perform other essential downhole functions. For instance, a gas separator can be attached to the clean water injection systems to handle excess gas before the gas passes through the separator.

The production zone 15 and injection zone 16 may also be separated by other downhole means, such as a liner hanger instead of a stand alone packer 32. The clean water injection system with an encapsulated electric submersible pumping device 60 is designed to work with the other tools that one skilled in the art uses to produce hydrocarbons and inject fluids in a downhole environment.

The separator 18 can be regulated by monitoring either the water content of the hydrocarbon-rich stream 42 or the oil content of the water-rich stream 44. The sensor 100 can be used to determine the fluids density and thus its relative hydrocarbon content. Based on this data, the relative flow rates can be regulated by adjusting a water-rich stream choke (not shown), a hydrocarbon-rich stream choke (not shown) and the separation unit operating speed.

While presently preferred embodiments have been described for purposes of this disclosure, numerous changes may be made, some indicated above, which will readily suggest themselves to one skilled in the art and which are encompassed in the spirit of the invention disclosed and as defined in the appended claims.

We claim:

1. A clean water injection system for use in conjunction with a wellbore in communication with a production zone and an injection zone and having a producing string of tubing disposed therein, the system comprising:

a surface separator having an inlet and a first outlet and a second outlet such that a produced hydrocarbon and water mixture enters from the production zone through the inlet and is separated into a hydrocarbon-rich stream and a water-rich stream that can be ejected through the first and second outlets respectively;

a surface horizontal pump system disposed near the wellbore and in fluid communication with the surface separator such that the horizontal pump system moves water from the surface separator to the injection zone; and an electric submersible pumping device in fluid communication with the separator for pressurizing the hydrocarbon and water mixture for separation comprising:

a packer disposed in the wellbore with the string of tubing;

a pump assembly supported by the string of tubing and having a pump inlet in fluid communication with the produced hydrocarbon and water mixture and having a pump outlet in fluid communication with the surface separator; and an electric submersible motor assembly; and wherein the separator is a rotary separator and wherein the torque is transferred between the horizontal pumping system and the rotary separator.

2. The system of claim 1 further comprising a second string of tubing disposed in the wellbore and in fluid communication with the horizontal pumping system for delivering the pressurized water mixture to the injection zone.

3. A clean water injection system for use in conjunction with a wellbore, the system comprising:

a separator having an inlet and a first outlet and a second outlet such that a produced hydrocarbon and water mixture enters from a production zone through the inlet and is separated into a hydrocarbon-rich stream and a water-rich stream that can be ejected through the first and second outlets respectively;

a horizontal pump system disposed near the wellbore and in fluid communication with the separator such that the horizontal pump system moves water from the separator to an injection zone; and an encapsulated device in fluid communication with the separator for pressurizing the hydrocarbon and water mixture for separation comprising:

a device body forming a chamber having an upper and lower surface such that the upper surface includes a device outlet and abuts an upper connection that includes a pressure seal and the lower surface includes a device inlet in fluid communication with the produced hydrocarbon and water mixture and abuts a lower connection;

a pump assembly supported by the device body, with a pump inlet in fluid communication with the produced hydrocarbon and water mixture and a pump outlet in fluid communication with the pressure sealed device outlet; and an electric submersible motor assembly.

4. The system of claims 3 wherein the upper connection is a hanger connection comprising:

a hanger body forming a first chamber and a second chamber and having an upper surface and a lower surface such that the hanger body can be supported by the device body;

the first chamber having a means of connecting the pump assembly to the hanger body;

the second chamber having a means of connecting the cable connection to the hanger body; and the pressure seal, located between the device body and the hanger body, capable of isolating pressure below the hanger body from pressure above the hanger body.

5. The system of claim 4 wherein the lower connection is a base connection comprising:

a base body forming a chamber having an upper surface and a lower surface such that the base body can be supported by the device body;

the base body having an outer surface and an inner surface such that the outer surface has a means of connecting the device to other objects; and the lower surface containing the encapsulated device inlet.

6. The system of claim 5 wherein the encapsulated device further comprises a motor seal and a sensor device mounted adjacent the motor seal to measure fluid and mechanical conditions and a control device capable of regulating these conditions within the encapsulated device.

7. The system of claim 5 further comprising a second tubing string disposed in the wellbore in fluid communication with the horizontal pumping system for delivering the pressurized water mixture to the injection zone.

8. The system of claim 5 wherein the separator is a rotary separator.

9. The system of claim 8 wherein the torque is transferred between the horizontal pumping system and the rotary separator.

10. A method for separating hydrocarbon from water using a clean water injection system having a rotary separator, the method comprising:

disposing an encapsulated pumping device in a wellbore such that the device is in fluid communication with the separator for drawing a produced hydrocarbon and water mixture into the rotary separator for separation into a hydrocarbon-rich stream and a water-rich stream, the encapsulated device comprising:

a device body forming a chamber having an upper and lower surface such that the upper surface includes a device outlet and an upper connection with a pressure seal and the lower surface includes a lower connection and a device inlet in fluid communication with the produced hydrocarbon and water mixture;

a pump assembly supported by the device body, with a pump inlet in fluid communication with the produced hydrocarbon and water mixture and a pump outlet in fluid communication with the pressure sealed device outlet; and an electric submersible motor assembly;

using a horizontal pumping system in fluid communication with the separator for pressurizing the water-rich stream for reinjection; and transferring torque from the horizontal pumping system to the rotary separator for separation of the hydrocarbon from the water.

* * * * *

UNITED STATES PATENT AND TRADEMARK OFFICE

CERTIFICATE OF CORRECTION

PATENT NO. : 6,457,522 B1 
DATED : October 1, 2002
INVENTOR(S) : Yasser Khan Bangash, John Derek Jones and Michael R. Berry It is certified that error appears in the above-identified patent and that said Letters Patent is hereby corrected as shown below:

Column 5,
Line 31, replace "shows a shows a" with -- shows a --
Line 49, replace "shows a shows a" with -- shows a --

Signed and Sealed this

Eleventh Day of February, 2003

JAMES E. ROGAN
*Director of the United States Patent and Trademark Office*